United States Patent [19]

Satomi

[11] 4,336,863

[45] Jun. 29, 1982

[54] SILENCER IN GAS FLOW PASSAGE

[75] Inventor: Seigo Satomi, Nagoya, Japan

[73] Assignee: NGK Insulators, Ltd., Nagoya, Japan

[21] Appl. No.: 280,217

[22] Filed: Jul. 6, 1981

[30] Foreign Application Priority Data

Dec. 5, 1980 [JP] Japan ..... 55-175358[U]

[51] Int. Cl.[3] ..... E04F 17/04; F01N 1/10

[52] U.S. Cl. ..... 181/224; 181/252; 181/270

[58] Field of Search ..... 181/222, 224, 252, 256, 181/270, 281, 210

[56] References Cited

U.S. PATENT DOCUMENTS 3,841,434 10/1974 Culpepper, Jr. ..... 181/224

4,274,506 6/1981 Blomgoen et al. ..... 181/210

*Primary Examiner*—George H. Miller, Jr.

*Assistant Examiner*—Benjamin R. Fuller

*Attorney, Agent, or Firm*—Stevens, Davis, Miller & Mosher

[57] ABSTRACT

The invention relates to an improvement of a silencer arranged in a gas flow passage of a gas supply or exhaust system and includes a sound absorbing material lined on wall surfaces of the gas flow passage in a duct casing. According to the invention, the sound absorbing material is covered with guard plates, each provided with a number of sound absorbing apertures and oblique plates located at edges of the apertures, for preventing gas flow from entering the sound absorbing material. The silencer according to the invention is capable of preventing accumulation of dust on the sound absorbing material and eliminating damage to the sound absorbing material due to entering of the gas flow thereinto. Thus, the silencer is particularly useful to diminish noise which is caused by gas flow when the gas contains a great amount of dust or when the gas flows at a high speed.

5 Claims, 4 Drawing Figures

SILENCER IN GAS FLOW PASSAGE

BACKGROUND OF THE INVENTION

1. Field of the Invention

This invention relates to a silencer arranged in a gas flow passage of an exhaust gas system, blower or the like, to reduce sound or noise transmitting through gases in the passage.

2. Description of the Prior Art

In order to reduce the sound transmitting through a gas in a gas flow passage, silencers located in the passages have been widely used, wherein sound absorbing materials are attached to desired inner surfaces of a suitable number of the gas flow passages provided in duct casings. With such silencers, however, the sound absorbing materials are likely to be damaged by high speed gas flows, and dust in the gas flows is apt to adhere and accumulate onto surfaces of the sound absorbing materials so as to reduce their sound absorbing coefficients and diminish their acoustic absorptivity for a short period of time. Moreover, there have been attempts to arrange a series of plates having apertures on inner surfaces of sound absorbing material to prevent the material from being damaged. In this case, however, as the dust in gas flow is more prone to accumulate at the apertures of the sound absorbing plates, the rapid diminishing of the acoustic absorptivity due to the accumulation of dust is not eliminated. Accordingly, it has been expected in this industrial field to obtain a silencer capable of maintaining its sound absorbing coefficient at its initial high level without damage to a sound absorbing material.

SUMMARY OF THE INVENTION

It is therefore a primary object of the invention to provide an improved silencer which eliminates a disadvantage in that when a prior art silencer is used in gas flow including dust, it accumulates on surfaces of a sound absorbing material to reduce a sound absorbing effect, resulting in a shortening of a service life of the silencer.

It is a still more specific object of the invention to provide a silencer comprising novel guard plates for preventing dust in a gas flow from accumulating on surfaces of a sound absorbing material, that is, each guard plate formed with a number of sound absorbing apertures and oblique plates at edges of the apertures to prevent the gas flow from directly entering the sound absorbing material.

The invention will be more fully understood by referring to the following detailed specification and claims taken in connection with the appended drawings.

DETAILED DESCRIPTION OF THE PREFERRED EMBODIMENT

Figure 1:
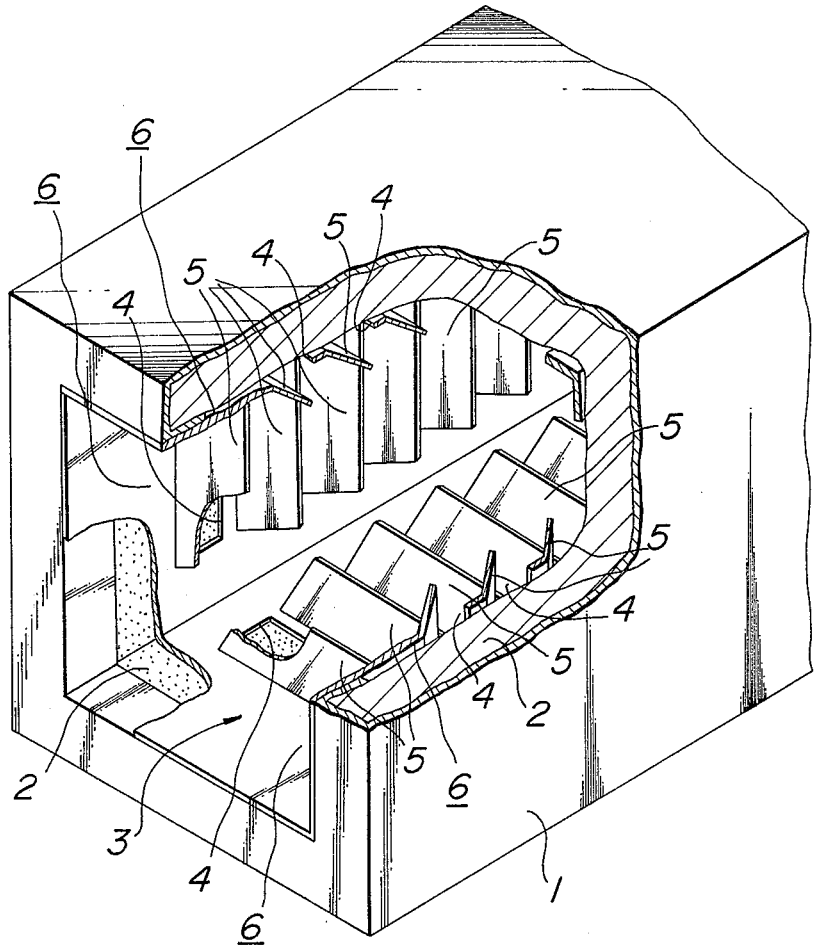
FIG. 1 is a partially removed perspective view illustrating one embodiment of a silencer according to the invention.

Referring to FIGS. 1–4, particularly FIG. 1, a sound absorbing material 2 is attached to required inner surfaces of a suitable number of gas flow passages 3 arranged in a duct casing 1. According to the invention, the sound absorbing material is provided on its inner sides with a series of guard plates 6 having a number of sound absorbing apertures 4 and oblique plates 5 located at opening edges of the sound absorbing apertures 4 for preventing gas flow from directly flowing into the sound absorbing material 2 through the sound absorbing apertures 4.

Figure 2:
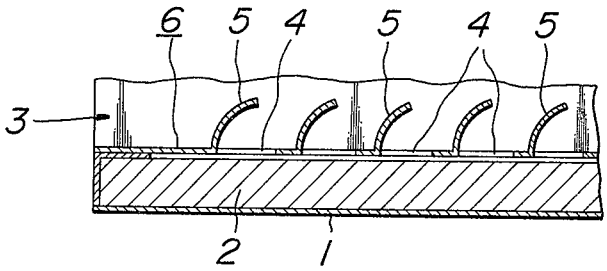
FIG. 2 is a partial sectional view of another embodiment of the invention.
Figure 3:
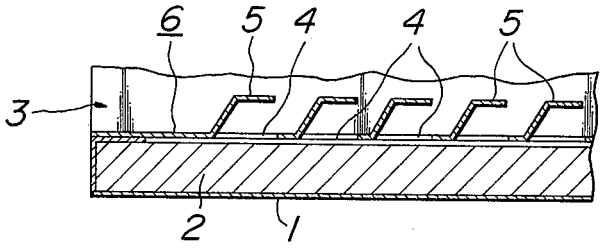
FIG. 3 is a partial sectional view of a further embodiment of the invention.
Figure 4:
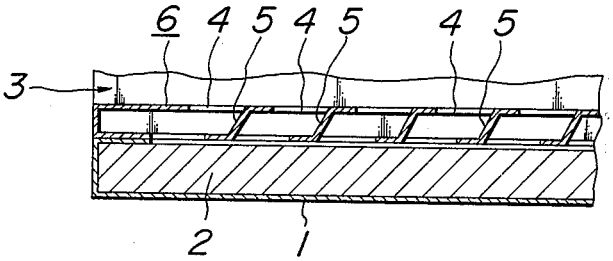
FIG. 4 is a partial sectional view of a particular embodiment of the invention.

FIGS. 2–4 illustrate various embodiments of the oblique plates 5 and guard plates 6. Referring to FIG. 2, the oblique plates 5 have an arcuate cross-section. FIG. 3 illustrates oblique plates 5 each consisting of an oblique portion and a free end portion substantially in parallel with the guard plate 6. In manufacturing the guard plate 6 shown in FIG. 2 or 3, an elongated rectangular single metal plate is punched to simultaneously form a number of the oblique plates 5 and the guard plate 6 in a unitary construction as explained later. In manufacturing the guard plate shown in FIG. 4, a guard plate 6 as formed in FIG. 3 is turned upside down and four edges of the guard plate 6 are bent downwardly substantially at right angles to a plane of the guard plate, and again bent inwardly at the same angles, to define four channel-shaped edges, thereby obtaining oblique plates 5 and a guard plate 6 in a unitary construction as shown in FIG. 4.

The silencer constructed as above-described is arranged in a gas flow passage of an exhaust gas system or air blower, in the same manner as in a silencer of this kind in the prior art, to absorb or damp the noise or sound transmitting in the gas stream passing through a suitable number of fluid passages 3 formed in the duct casing 1 by the sound absorbing material 2 such as fibrous or ceramic or porous synthetic resin sound absorbing material.

In this case, the silencer according to the invention comprises a series of the guard plates 6 of a metal or the like on the inner surfaces of the sound absorbing material 2 attached to desired inner surfaces of a suitable number of the gas flow passages 3 provided in the duct casing. Each of the guard plates is formed with an absorbing aperture 4 on one side of the guard plate. An oblique plate 5 on one edge of the sound absorbing aperture 4 prevents the gas flow from directly flowing into the sound absorbing material 2 through the sound absorbing apertures 4. The oblique plate is preferably affixed to a guard plate 6. Consequently, the gas stream flowing from an inlet to an outlet passes through the fluid passages 3 without directly entering the sound absorbing material 2 exposed through the sound absorbing apertures 4 with the guarding effect of the oblique plates 5. The noise or sound in the gas stream is absorbed by the sound absorbing material 2 exposed through the apertures 4, thereby securely preventing the damage to the surfaces of the sound absorbing material which would otherwise occur when a high speed gas stream came directly in contact with the sound absorbing material 2.

Moreover, the oblique plates 5 which prevent the gas stream from directly flowing into the sound absorbing material 2 also serve to prevent dust included in the gas stream from accumulating on, or near, the sound absorbing apertures 4, or attaching to the surfaces of the sound absorbing material 2 exposed through the sound absorbing apertures 4. Accordingly, the sound absorbing material 2 exhibits its inherent sound absorbing effect for a long period of time whereas the prior art would lose such an effect after a short period of time.

A ratio of areas of all the sound absorbing apertures 4 to the guard plate 6 is not necessarily limited. A ratio of the openings to the plate which is greater than 20% ensures a sufficient sound absorbing effect because a part of the sound transmitting through the gas flow is reflected at the oblique plate toward an upstream thereof when the gas passes through the gas passage. Moreover, it is possible to suitably determine lengths of long and short sides of the rectangular sound absorbing apertures 4, and lengths and angles of the oblique plates 5, according to applications of the silencer.

In manufacturing the silencer according to the invention, a metal plate is punched by press forming to form a number of the sound absorbing apertures 4 simultaneously with the oblique plates 5 at the opening edges of the apertures 4 so as to obtain a guard plate 6 in a unitary construction. A series of the guard plates 6 are continuously arranged on inner surfaces of the sound absorbing material 2 forming the gas passages 3 in a duct casing 1. As the silencer according to the invention can be easily manufactured in this manner, it is inexpensive to manufacture.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A silencer including a sound absorbing material forming walls of gas flow passages in a duct casing, said silencer comprising guard plates for covering surfaces of said sound absorbing material facing said gas flow passages, each said guard plate being formed with a number of sound absorbing apertures and provided at edges of said sound absorbing apertures with oblique plates continuous with said edges and bent inclined to a surface of said guard plate such that gas flow is prevented from directly entering said sound absorbing material through said sound absorbing apertures.

2. A silencer as set forth in claim 1, wherein said guard plate is a metal and said sound absorbing apertures and said oblique plates are formed simultaneously by press forming.

3. A silencing device as set forth in claim 2, wherein each said oblique plate has an arcuate cross-section.

4. A silencing device as set forth in claim 2, wherein each said oblique plate consists of an oblique portion and a free end portion substantially in parallel with said guard plate.

5. A silencing device as set forth in claim 2, wherein said guard plate comprises said oblique plates each consisting of an oblique portion and a free end portion substantially in parallel with said guard plate and further comprises channel-shaped portions at four edges of the guard plate.

* * * * *